US005467841A

United States Patent [19]

Krumal

[11] Patent Number: 5,467,841

[45] Date of Patent: Nov. 21, 1995

[54] ESCAPE WINDOW FRAME ASSEMBLY

[76] Inventor: Frank K. Krumal, 5 Bradford St., Schenectady, N.Y. 12306

[21] Appl. No.: 260,255

[22] Filed: Jun. 14, 1994

[51] Int. Cl.[6] ..... A62B 1/00

[52] U.S. Cl. ..... 182/70; 182/198

[58] Field of Search ..... 182/70, 73, 74, 182/75, 76, 196, 197, 198, 199

[56] References Cited

U.S. PATENT DOCUMENTS

| | | | |
|---|---|---|---|
| 263,952 | 9/1882 | Penn | 182/76 X |
| 1,397,643 | 11/1921 | Lyle | 182/76 |
| 2,709,030 | 5/1955 | Vroman | 182/76 X |
| 3,847,246 | 11/1974 | Banner | 182/70 X |
| 5,020,633 | 6/1991 | Rangel | 182/70 |
| 5,372,217 | 12/1994 | Hsu | 182/198 X |

*Primary Examiner*—Alvin C. Chin-Shue

[57] ABSTRACT

Disclosed is a new escape window frame assembly for facilitating emergency egress from a building by using a window frame having a concealed collapsible escape ladder which is cleared for deployment when a window mounted within the frame is pivoted outwardly for providing an escape portal. The escape window frame assembly comprises a window frame having a conventional prefabricated window assembly hingedly mounted therein such that the window assembly may pivot outwardly from the frame. The frame has an open space under the window assembly wherein a flexible ladder is secured. The ladder, fixedly connected at one end inside the open space, has a normal storage position wherein the ladder is coiled inside the open space and an emergency deployed position wherein the ladder extends from the frame downwardly to an escape staging area outside the building. A shear pin secures the window assembly in a normally closed position. Outwardly directed firm hand pressure delivered against the window assembly proximal the shear pin will break the pin allowing the window assembly to pivot outwardly to an emergency open position.

17 Claims, 4 Drawing Sheets

ESCAPE WINDOW FRAME ASSEMBLY

BACKGROUND OF THE INVENTION

1. Field of the Invention

The present invention relates to escape devices and more particularly pertains to an escape window frame assembly which may be adapted for facilitating emergency egress from a building by using a window frame having a concealed collapsible escape ladder which is cleared for deployment when a window mounted within the frame is pivoted outwardly for providing an escape portal.

2. Description of the Prior Art

The use of escape devices is known in the prior art. More specifically, escape devices heretofore devised and utilized for the purpose of emergency escape from a building are known to consist basically of familiar, expected and obvious structural configurations, notwithstanding the myriad of designs encompassed by the crowded prior art which have been developed for the fulfillment of countless objectives and requirements.

The present invention is directed to improving devices for emergency escape from a building in a manner which is safe, secure, economical and aesthetically pleasing.

Relevant prior art patents include U.S. Pat. No. 5,070,963 to Fusco which describes a foldable extension escape ladder bookshelf/table/stool/chest of drawers and U.S. Pat. No. 5,022,491 to Gill which discloses a collapsible fire escape ladder.

The prior art also discloses an escape ladder as shown in U.S. Pat. No. 5,012,892 to Kelly and self storing fire escape ladders of U.S. Pat. No. 3,946,834 to Shafer et al. and U.S. Pat. No. 3,677,366 to Loeffel.

While these devices fulfill their respective, particular objectives and requirements, the aforementioned patents do not disclose an escape window frame assembly for facilitating emergency egress from a building by using a window frame having a concealed collapsible escape ladder which is cleared for deployment when a window mounted within the frame is pivoted outwardly to provide an escape portal.

In this respect, the escape window frame assembly according to the present invention substantially departs from the conventional concepts and designs of the prior art, and in so doing provides an apparatus primarily developed for the purpose of facilitating emergency egress from a building by using a window frame having a concealed collapsible escape ladder which is cleared for deployment when a window mounted within the frame is pivoted outwardly for providing an escape portal.

Therefore, it can be appreciated that there exists a continuing need for a new escape window frame assembly which can be used for facilitating emergency egress from a building by using a window frame having a concealed collapsible escape ladder which is cleared for deployment when a window mounted within the frame is pivoted outwardly for providing an escape portal. In this regard, the present invention substantially fulfills this need.

As illustrated by the background art, efforts are continuously being made in an attempt to develop devices for emergency escape from a building. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of escape devices now present in the prior art, the present invention provides a new escape device construction wherein the same can be utilized for facilitating emergency egress from a building by using a window frame having a concealed collapsible escape ladder which is cleared for deployment when a window mounted within the frame is pivoted outwardly for providing an escape portal. As such, the general purpose of the present invention, which will be described subsequently in greater detail, is to provide a new escape window frame assembly apparatus and method which has all the advantages of the prior art escape devices and none of the disadvantages.

The invention is defined by the appended claims with the specific embodiment shown in the attached drawings. For the purpose of summarizing the invention, the invention may be incorporated into a new escape window frame assembly for facilitating emergency egress from a building.

The escape window frame assembly comprises a generally rectangular window frame for conventional mounting in a building wall window cutout, The frame has inward and outward facing sides for normal mounting facing the respective interior and exterior of the building, The frame also has a conventional prefabricated double hung window assembly hingedly mounted therein such that the window assembly may pivot outwardly from the frame, The frame is slightly longer than the window assembly to provide an open space within the frame under the window assembly, The frame additionally has a partition extending across the open space whereby covering the inwardly facing side of the open space, Releasable securement means is provided to secure the window assembly in a normally closed position within the frame, The releasable securement means comprises a shear pin extending through a hole in the window assembly opposite the hinge, The shear pin also extends through a hole in the frame such that outwardly directed firm hand pressure delivered against the window assembly proximal the shear pin will break the pin allowing the window assembly to pivot outwardly to an emergency open position, Latch means is also provided to automatically releasably latch the widow assembly in the emergency open position when pivoted outwardly. The latch means comprises a pair of conventional cabinet door latching arm assemblies extending between the window frame and the window assembly, the latching arm assemblies being mounted to opposing sides of the window assembly and frame combination.

A cover plate extends from the bottom of the window assembly such that the outwardly facing side of the open space is covered when the window assembly is in the normally closed position. The cover plate is fixedly attached to the window assembly such that the outwardly facing side of the open space is uncovered when the window is pivoted to the emergency open position.

A rigid attachment bar extends horizontally across the inside of the open space, the bar being fixedly connected to the frame at both ends thereof.

A flexible ladder is fixedly connected at one end to the attachment bar. The ladder has a normal storage position wherein the ladder is coiled resting within the open space of the frame, and also has an emergency deployed position wherein the ladder extends from the frame downwardly to an escape staging area outside the building below the escape window frame assembly.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new escape window frame assembly for facilitating emergency egress from a building.

It is another object of the present invention to provide a new escape window frame assembly which may be easily and efficiently manufactured and marketed.

It is a further object of the present invention to provide a new escape window frame assembly which is of a durable and reliable construction.

An even further object of the present invention is to provide a new escape window frame assembly which is susceptible of a low cost of manufacture with regard to both materials and labor, and which accordingly is then susceptible of low prices of sale to the consuming public, thereby making such escape window frame assemblies economically available to the buying public.

Still yet another object of the present invention is to provide a new escape window frame assembly which provides in the apparatuses and methods of the prior art some of the advantages thereof, while simultaneously overcoming some of the disadvantages normally associated therewith.

Still yet another object of the present invention is to provide a new escape window frame assembly that incorporates a concealed collapsible escape ladder.

Yet another object of the present invention is to provide a new escape window frame assembly that may be pivoted outwardly for providing an escape portal.

Even still another object of the present invention is to provide a new escape window frame assembly that provides an alternate way for firemen, police, emergency medical technicians, and other emergency workers to enter a building during an emergency.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
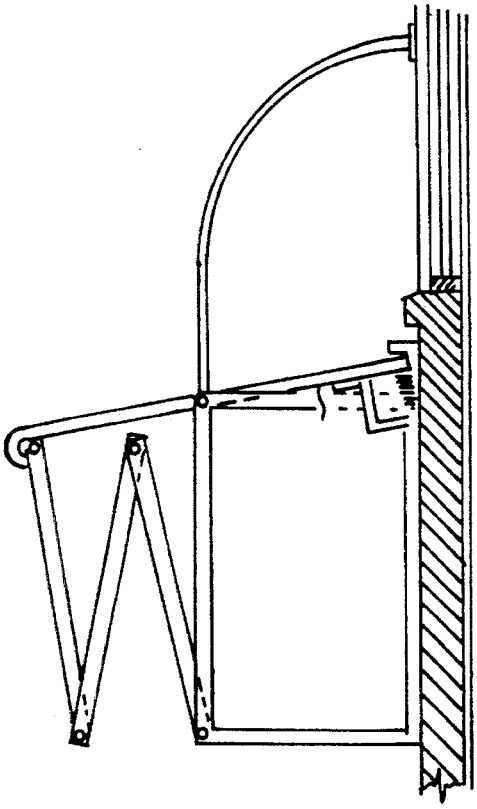
FIG 1 PRIOR ART
FIG. 1 is a side view of a prior art escape ladder.
Figure 2:
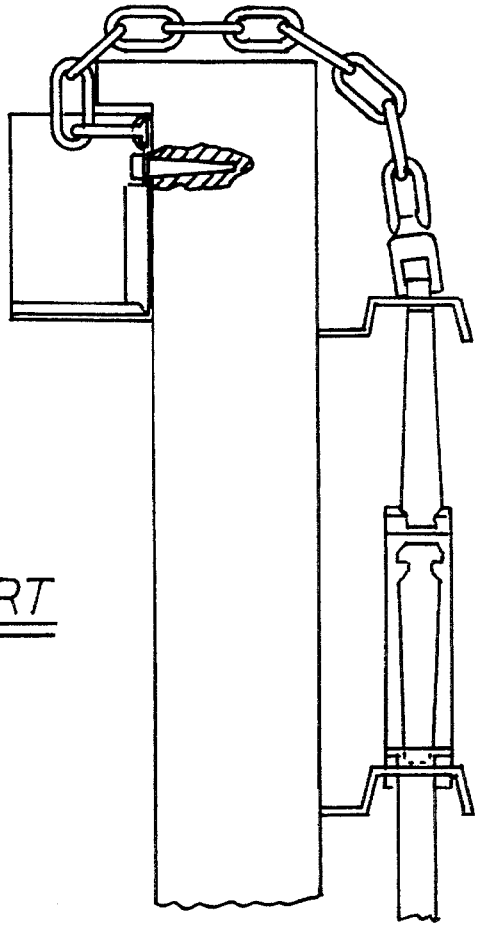
FIG 2 PRIOR ART
FIG. 2 is a fragmentary transverse sectional view of a prior art self-storing fire escape ladder.
Figure 3:
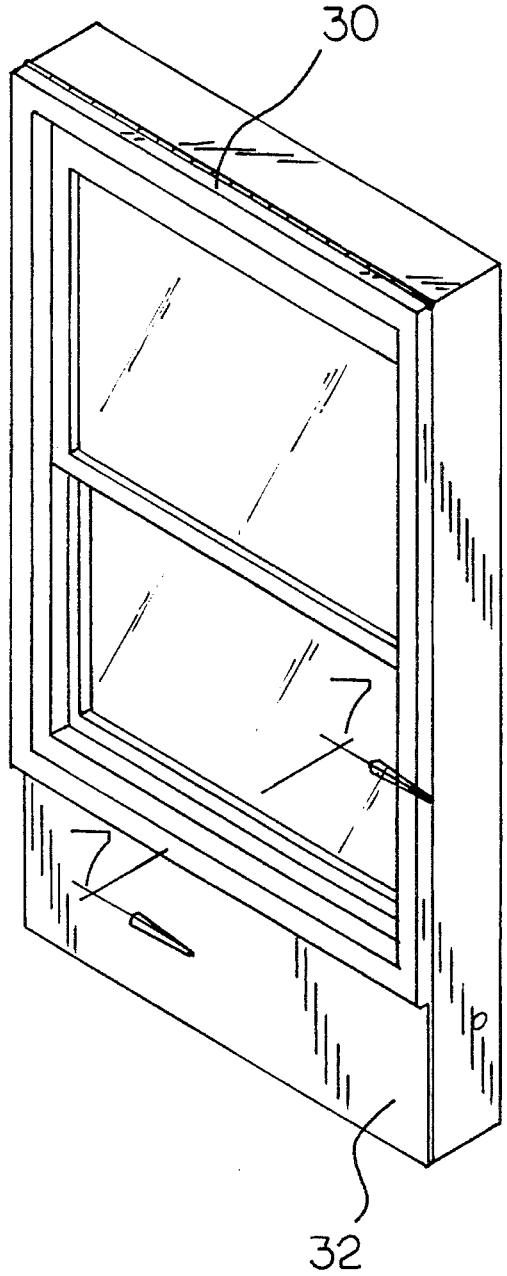
FIG. 3 is atop front perspective view of the preferred embodiment of the present escape window frame assembly exterior showing the window assembly in the normal closed position.
Figure 4:
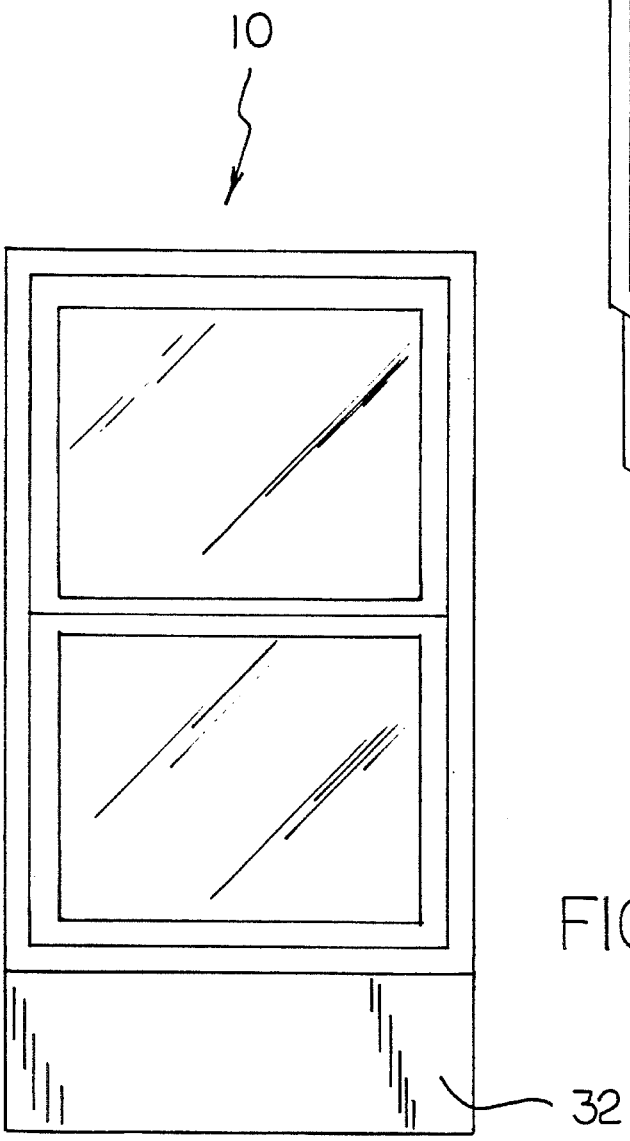
FIG. 4 is a front elevational view of the invention of FIG. 3.
Figure 5:
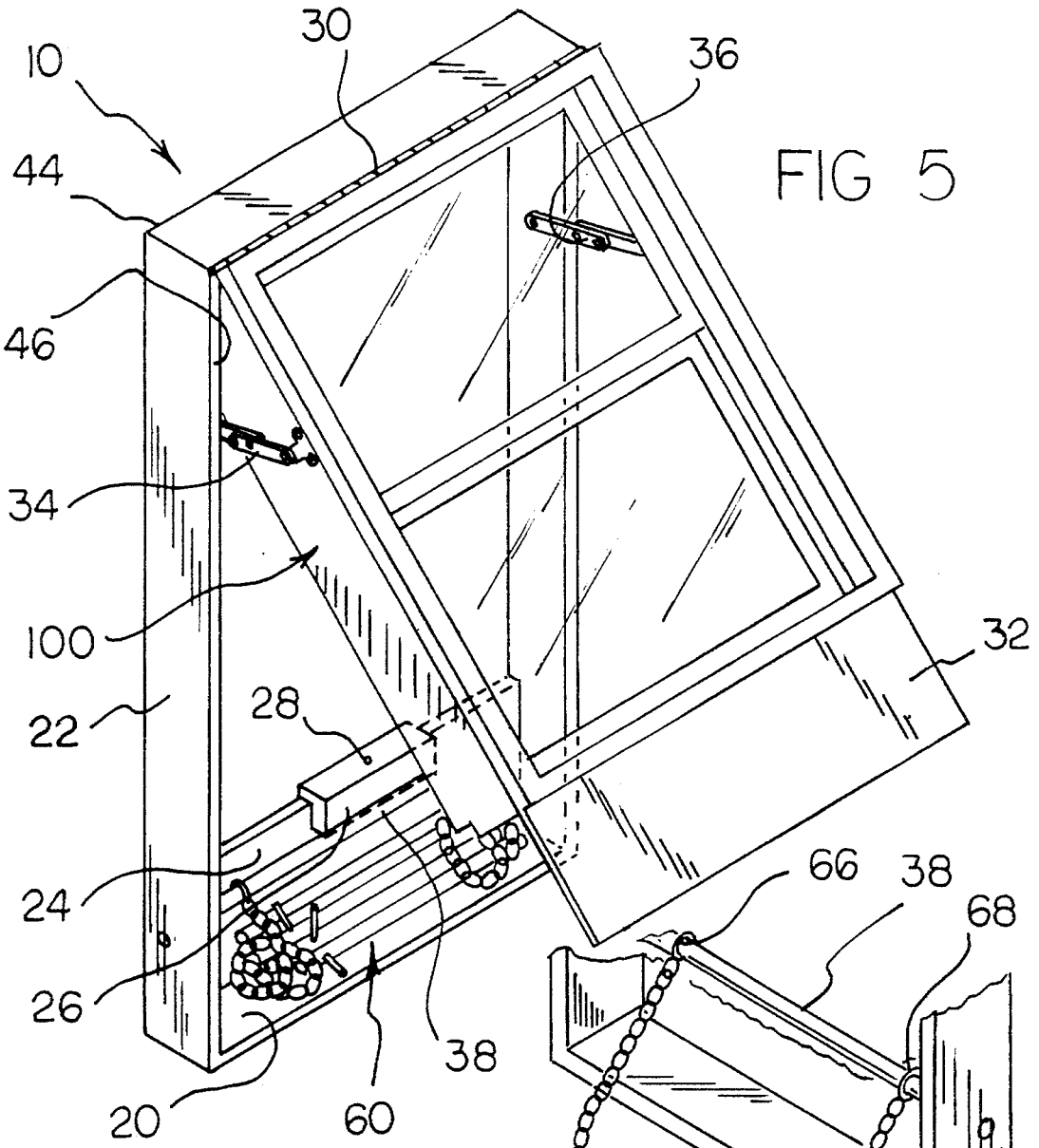
FIG. 5 is a top front perspective view of the invention of FIG. 3 showing the window assembly in the emergency open position.

With reference now to the drawings, and in particular to FIG. 5 thereof, a new escape window frame assembly embodying the principles and concepts of the present invention and generally designated by the reference numeral 10 will be described.

Figure 6:
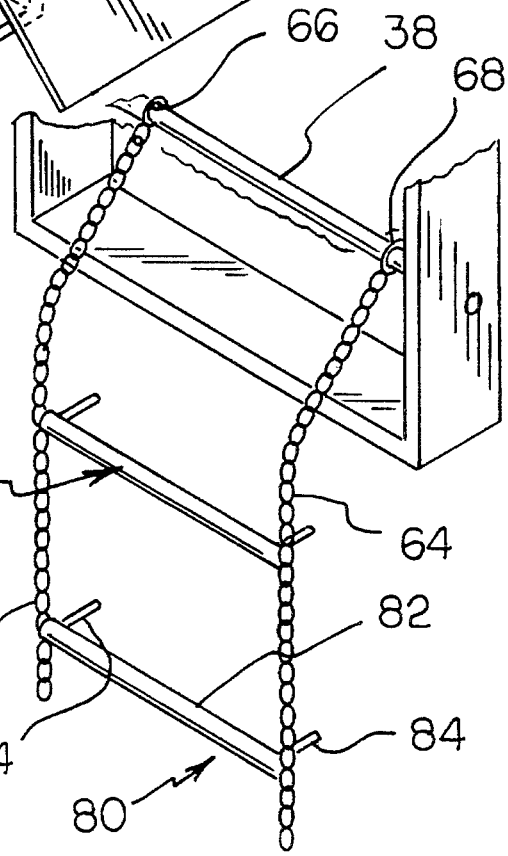
FIG. 6 is a fragmentary top perspective view of the invention of FIG. 5 showing the ladder in the deployed position.
Figure 7:
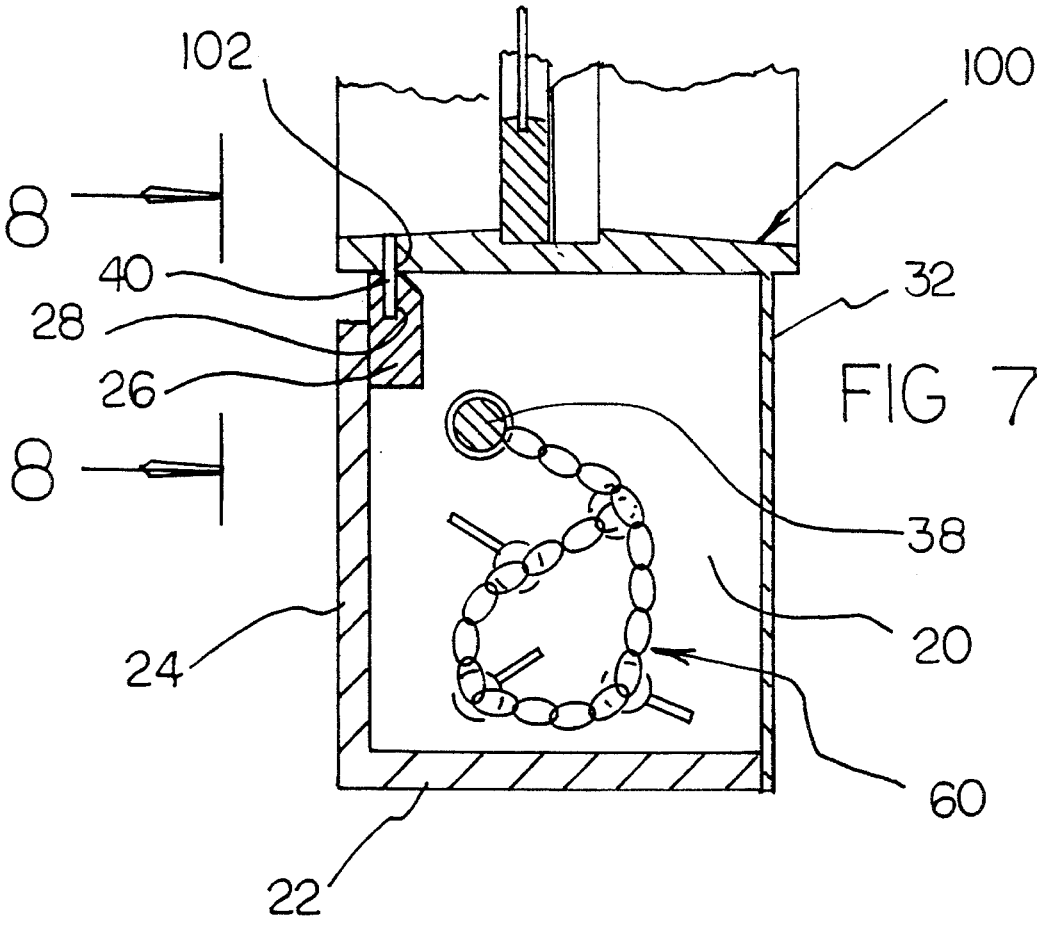
FIG. 7 is a sectional view of the invention of FIG. 3 taken along the line 7—7.
Figure 8:
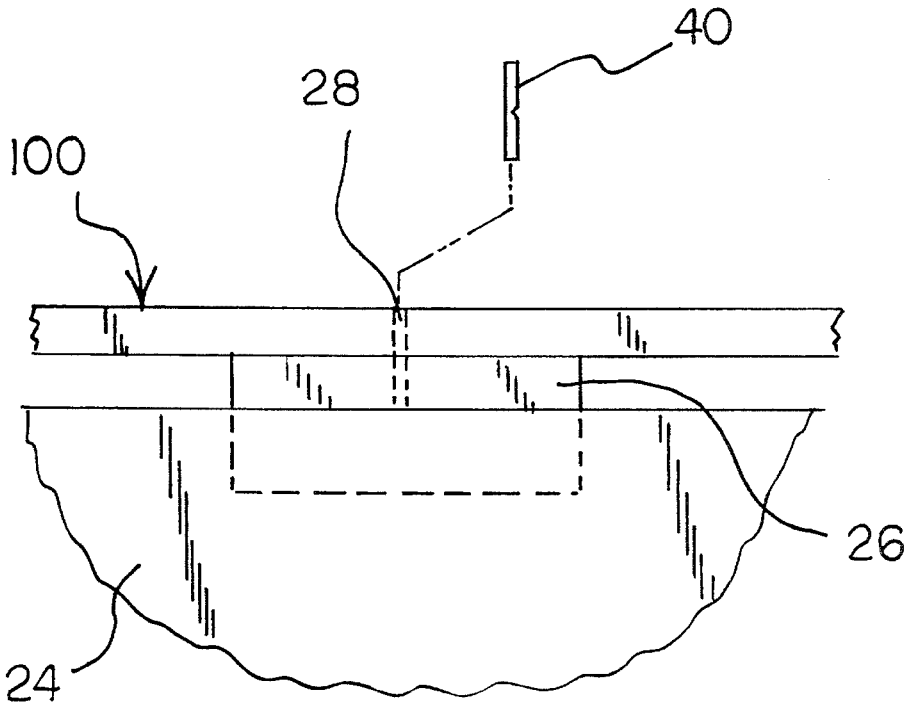
FIG. 8 is a fragmentary rear elevational detail view of the invention of FIG. 7 taken along the line 8—8 and showing the location of the shear pin.

From an overview standpoint, the escape window frame assembly is adapted for use for facilitating emergency egress from a building by using a window frame having a concealed collapsible escape ladder which is cleared for deployment when a window mounted within the frame is pivoted outwardly for providing an escape portal. See FIGS. 5 and 6.

With reference now to FIGS. 3–8 and more specifically, it will be noted that an escape window frame assembly 10 is shown.

The escape window frame assembly 10 comprises a generally rectangular window frame 22 for conventional mounting in a building wall window cutout. The frame 22 has inward and outward facing sides 44 and 46 for normal mounting facing the respective interior and exterior of the building. The frame 22 also has a conventional prefabricated double hung window assembly 100 hingedly mounted therein such that the window assembly 100 may pivot outwardly from the frame 22. A hinge 30 extends along the top of the frame 22 and window assembly 100 to allow the bottom of the window assembly 100 to pivot outwardly from the frame 22. The frame 22 is slightly longer than the window assembly 100 to provide an open space 20 within the frame 22 under the window assembly 100. The frame 22 additionally has a partition 24 extending across the open space 20 whereby covering the inwardly facing side of the open space.

Releasable securement means is provided to secure the window assembly 100 in a normally closed position within the frame 22. The releasable securement means comprises a shear pin 40 extending through a hole 102 in the window assembly opposite the hinge 30. The shear pin 40 also extends through a hole 28 in a reinforced portion 26 of the partition 24 such that outwardly directed firm hand pressure delivered against the window assembly 100 proximal the shear pin 40 will break the pin 40 allowing the window assembly 100 to pivot outwardly to an emergency open position.

Latch means is also provided to automatically releasably latch the widow assembly 100 in the emergency open position when pivoted outwardly. The latch means comprises a pair of conventional cabinet door latching arm assemblies 34 and 36 extending between the window frame 22 and the window assembly 100, the latching arm assemblies 34 and 36 being mounted to opposing sides of the window assembly 100 and frame 22 combination.

A cover plate 32 extends from the bottom of the window assembly 100 such that the outwardly facing side of the open space 20 is covered when the window assembly 100 is in the normally closed position. The cover plate 32 is fixedly attached to the window assembly 100 such that the outwardly facing side of the open space 20 is uncovered when the window assembly 100 is pivoted to the emergency open position.

A rigid attachment bar 38 extends horizontally across the inside of the open space 20, the bar being fixedly connected to the frame 22 at both ends thereof.

A flexible ladder 60 is fixedly connected at one end to the attachment bar 38. The ladder 60 has a normal storage position wherein the ladder is coiled resting within the open space 20 of the frame, and also has an emergency deployed position wherein the ladder 60 extends from the frame 22 downwardly to an escape staging area outside the building below the escape window frame assembly 10.

The ladder 60 comprises a pair of generally vertical parallel spaced apart support members 62 and 64 constructed of a plurality of interconnected metal chain links. Each support member 62 and 64 has a connecting ring 66 and 68 attached to an upper end thereof for encircling engagement with the attachment bar 38. A plurality of generally horizontal parallel spaced apart metal rungs 80 extends between the support members 62 and 64 to provide hand and foot holds, each rung 80 comprises a metal bar 82 fixedly connected at either end to a support member. Each rung 80 further has a standoff arm 84 fixedly connected to each end of the metal bar 82, normal the longitudinal axis of the bar 82. The standoff arms 84 are parallel to each other and aligned such that the bars 82 are held spaced away from the building exterior during emergency deployment of the ladder 60.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A new escape window frame assembly for facilitating emergency egress from a building by using a window frame having a concealed collapsible escape ladder which is cleared for deployment when a window mounted within the frame is pivoted outwardly for providing an escape portal, the escape window frame assembly comprising:

a generally rectangular window frame for conventional mounting in a building wall window cutout, the frame having inward and outward facing sides for normal mounting facing the respective interior and exterior of the building, the frame also having a conventional prefabricated window assembly hingedly mounted therein such that the window assembly may pivot outwardly from the frame, the frame being slightly longer than the window assembly to provide an open space within the frame under the window assembly, the frame additionally having a partition extending across the open space covering the inwardly facing side of the open space;

releasable securement means whereby the window assembly is secured in a normally closed position within the frame, the releasable securement means comprising a shear pin extending through a hole in the window assembly opposite the hinge, the shear pin also extending through a hole in the frame such that outwardly directed firm hand pressure delivered against the window assembly proximal the shear pin will break the pin allowing the window assembly to pivot outwardly to an emergency open position;

latch means whereby the widow assembly is automatically releasably latched in the emergency open position when pivoted outwardly, the latch means comprising a pair of conventional cabinet door latching arm assemblies extending between the window frame and the window assembly, the latching arm assemblies being mounted to opposing sides of the window assembly and frame combination;

a cover plate extending from the bottom of the window assembly such that the outwardly facing side of the open space is covered when the window assembly is in the normally closed position, the cover plate being fixedly attached to the window assembly such that the outwardly facing side of the open space is uncovered when the window is pivoted to the emergency open position;

a rigid attachment bar extending horizontally across the inside of the open space, the bar being fixedly connected to the frame at both ends thereof; and a flexible ladder fixedly connected at one end to the attachment bar, the ladder having a normal storage position wherein the ladder is coiled resting within the open space of the frame, the ladder also having an emergency deployed position wherein the ladder extends from the frame downwardly to an escape staging area outside the building below the escape window frame assembly.

2. The escape window frame assembly of claim 1 wherein said window assembly is a conventional prefabricated casement window assembly hingedly mounted therein.

3. The escape window frame assembly of claim 2 wherein said window assembly is a conventional prefabricated awning window assembly hingedly mounted therein.

4. The escape window frame assembly of claim 3 wherein the frame has a conventional prefabricated solid window assembly hingedly mounted therein.

5. The escape window frame assembly of claim 4 wherein the frame has a conventional prefabricated single window assembly hingedly mounted therein.

6. The escape window frame assembly of claim 5 wherein the window assembly is hingedly mounted within the frame across the top thereof such that the bottom of the window assembly may pivot outwardly from the frame.

7. The escape window frame assembly of claim 6 wherein the flexible ladder comprises: a pair of generally vertical parallel spaced apart support members constructed of a plurality of interconnected metal chain links, each support member having a connecting ring attached to an upper end thereof for encircling engagement with the attachment bar; and a plurality of generally horizontal parallel spaced apart metal rungs extending between the support members to provide hand and foot holds, each rung being fixedly connected at either end to a support member, each rung further having a standoff arm fixedly connected to each end thereof normal the longitudinal axis of the rung, the standoff arms being parallel to each other and aligned such that the rungs are held spaced away from the building exterior during emergency deployment of the ladder.

8. A new escape window frame assembly for facilitating emergency egress from a building by using a window frame having a concealed collapsible escape ladder which is cleared for deployment when a window mounted within the frame is pivoted outwardly for providing an escape portal, the escape window frame assembly comprising:

a generally rectangular window frame for conventional mounting in a building wall window cutout, the frame having a conventional prefabricated window assembly hingedly mounted therein such that the window assembly may pivot outwardly from the frame, the frame being slightly longer than the window assembly to provide an open space within the frame under the window assembly;

releasable securement means whereby the window assembly is secured in a normally closed position within the frame, the window assembly being releasable to an emergency open position;

latch means whereby the widow assembly is automatically releasably latched in the emergency open position when pivoted outwardly;

a cover plate extending from the bottom of the window assembly such that the outwardly facing side of the open space is covered when the window assembly is in the normally closed position, the cover plate being fixedly attached to the window assembly such that the outwardly facing side of the open space is uncovered when the window is pivoted to the emergency open position; and a flexible ladder fixedly connected at one end inside the open space of the frame, the ladder having a normal storage position wherein the ladder is coiled resting within the open space, the ladder also having an emergency deployed position wherein the ladder extends from the frame downwardly to an escape staging area outside the building below the escape window frame assembly.

9. The escape window frame assembly of claim 8 wherein said window assembly is a conventional prefabricated double hung window assembly hingedly mounted in the window frame.

10. The escape window frame assembly of claim 9 wherein the frame has a conventional prefabricated casement window assembly hingedly mounted therein.

11. The escape window frame assembly of claim 10 wherein the frame has a conventional prefabricated awning window assembly hingedly mounted therein.

12. The escape window frame assembly of claim 11 wherein the frame has a conventional prefabricated solid window assembly hingedly mounted therein.

13. The escape window frame assembly of claim 12 wherein the frame has a conventional prefabricated single window assembly hingedly mounted therein.

14. The escape window frame assembly of claim 13 wherein the releasable securement means comprises a shear pin extending through a hole in the window assembly opposite the hinge, the shear pin also extending through a hole in the frame such that outwardly directed firm hand pressure delivered against the window assembly proximal the shear pin will break the pin allowing the window assembly to pivot outwardly to the emergency open position.

15. The escape window frame assembly of claim 14 wherein the latch means comprises at least one conventional cabinet door latching arm assembly extending between the window frame and the window assembly.

16. The escape window frame assembly of claim 15 and further including a rigid attachment bar extending horizontally across the inside of the open space, the bar being fixedly connected to the frame at both ends thereof.

17. The escape window frame assembly of claim 16 wherein the flexible ladder comprises: a pair of generally vertical parallel spaced apart support members constructed of a plurality of interconnected metal chain links, each support member having a connecting ring attached to an lapper end thereof for encircling engagement with the attachment bar; and a plurality of generally horizontal parallel spaced apart metal rungs extending between the support members to provide hand and foot holds, each rung being fixedly connected at either end to a support member, each rung further having a standoff arm fixedly connected to each end thereof normal the longitudinal axis of the rung, the standoff arms being parallel to each other and aligned such that the rungs are held spaced away from the building exterior during emergency deployment of the ladder.

* * * * *